United States Patent [19]

MacCracken

[11] 3,986,342

[45] Oct. 19, 1976

[54] METHOD OF SECURING A PERIMETER FENCE AROUND AN ICE RINK WITHOUT EMBEDDING INTO GROUND

[76] Inventor: Calvin D. MacCracken, 92 Dwight Place, Englewood, N.J. 07631

[22] Filed: Aug. 29, 1975

[21] Appl. No.: 608,964

[52] U.S. Cl. ..... 62/66; 62/235; 272/3

[51] Int. Cl.[2] ..... A63C 19/10

[58] Field of Search ..... 62/66, 235; 272/3, 4, 272/56.5 SS; 273/1 B

[56] References Cited

UNITED STATES PATENTS

| | | | |
|---|---|---|---|
| 2,996,896 | 8/1961 | Johnson | 62/235 |
| 3,015,938 | 1/1962 | Vereyken | 62/66 |
| 3,751,935 | 8/1973 | MacCracken et al. | 62/235 X |
| 3,893,507 | 7/1975 | MacCracken et al. | 62/235 X |
| 3,930,647 | 1/1976 | Berlemont | 62/235 X |

*Primary Examiner*—William E. Wayner
*Assistant Examiner*—William E. Tapolcai, Jr.
*Attorney, Agent, or Firm*—Parmelee, Johnson & Bollinger

[57] ABSTRACT

With the great increase in the game of ice hockey there is demand for large numbers of lower cost portable ice rinks that can make dual use of recreational land. Heretofore, the hockey "dasher" boards around the perimeter of the ice rink have had to be fastened by embedding into concrete or other special solid base in order to withstand the battering and collisions of players, resurfacing machines and hockey equipment as well as the expanding pressure of the ice as it is constantly melted and refrozen at its edges. This has meant special preparations and difficulty in dual use of recreational areas as playing field, tennis courts, lawn area, parking lot, etc. A method of securing the dasher boards into the refrigerated ice slab is disclosed so that no attachment is required into the ground below and no damage is done to it. The ice is frozen as a continuous slab extending out for a foot or so behind the boards, the boards being supported on cantilever metal posts which provide bonding with the ice and provision for refrigerant piping underneath and behind the boards, and a cover box is provided which not only covers the bonding ice behind the boards but also acts as a cover for refrigerant header pipes instead of the usual expensive trench. Now for the first time unskilled personnel can completely assemble a refrigerated ice rink, make and maintain the ice, and then pack it away at the end of the season, allowing for the alternate recreational area use to begin.

14 Claims, 8 Drawing Figures

Fig_1
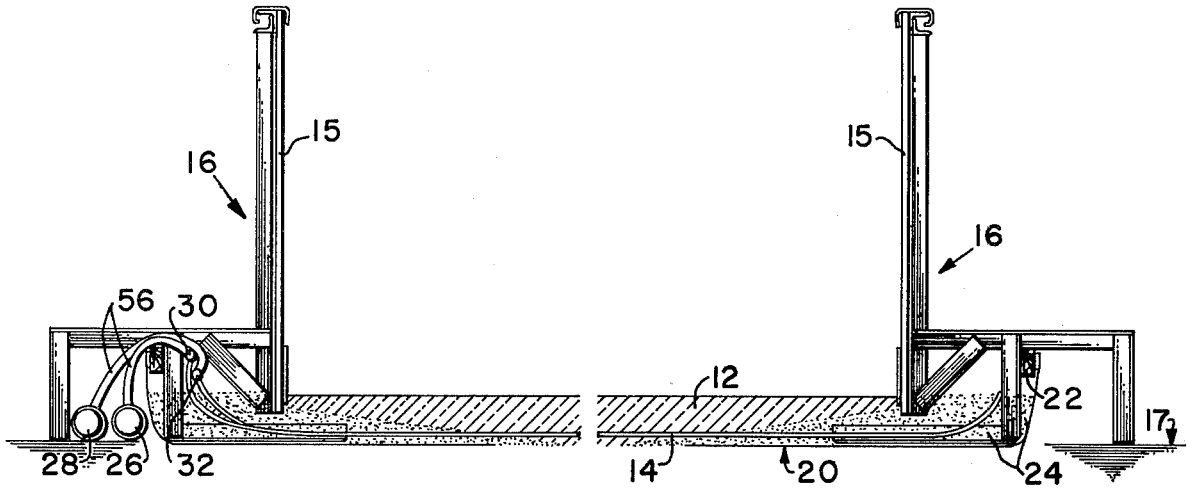
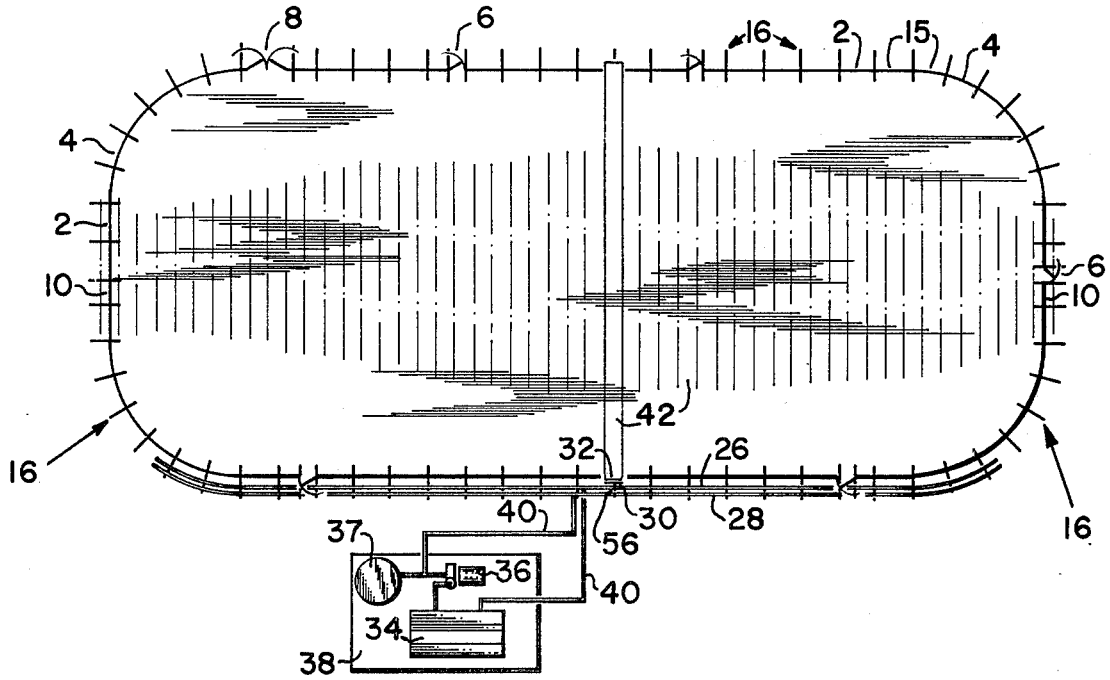
Fig_2

Fig-7
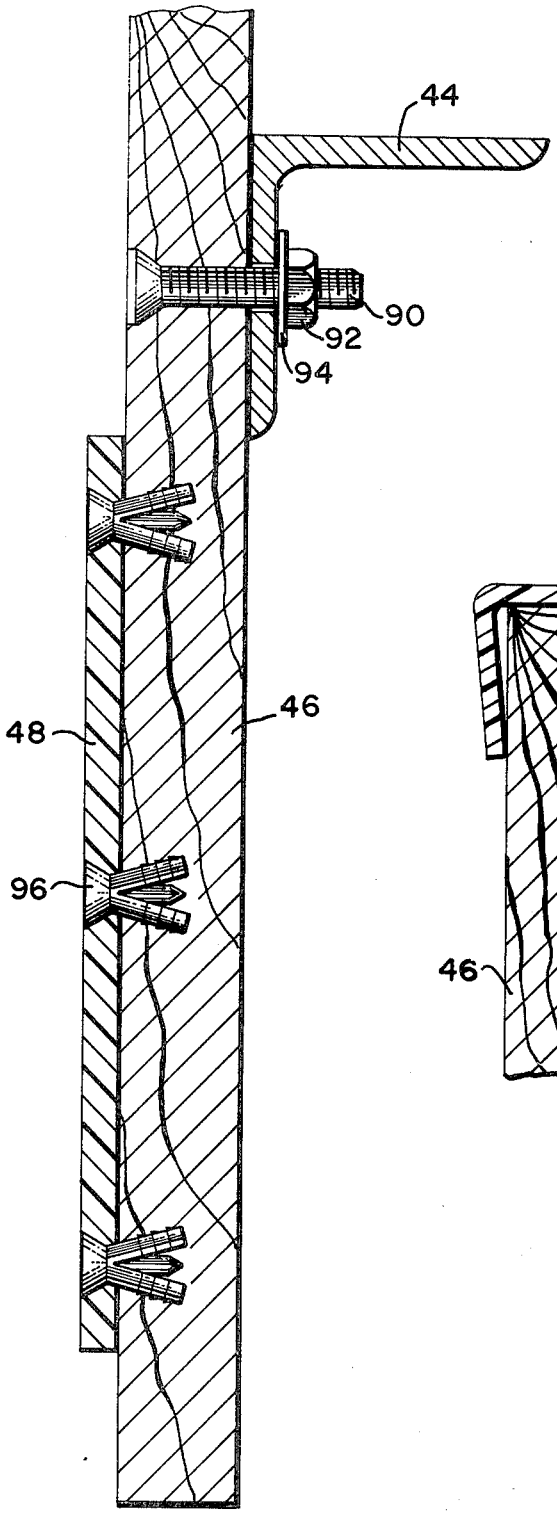
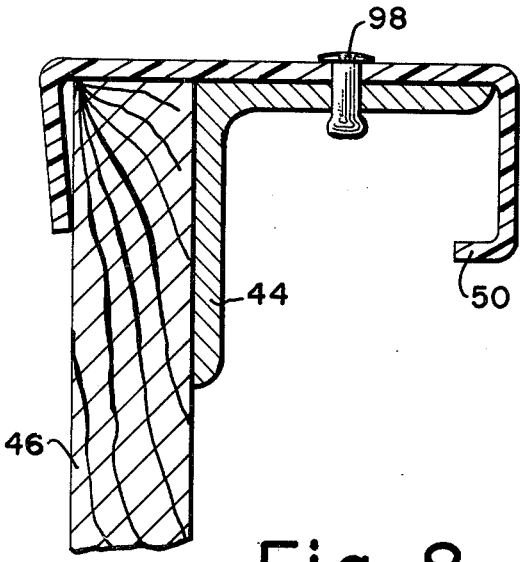
Fig-8

METHOD OF SECURING A PERIMETER FENCE AROUND AN ICE RINK WITHOUT EMBEDDING INTO GROUND

BACKGROUND AND PURPOSES OF THE INVENTION

Ice hockey, an international game of rapidly increasing popularity, requires the use of a solid perimeter fence, called dasher boards, preferably 42 inches high over the ice, with an abrasion resistant, smooth white vertical surface facing the ice. An additional replaceable kickplate is required extending several inches above the ice all around to absorb the most severe punishment of skates, sticks and pucks. The dimensions of the rink are generally 85 feet in width by 200 feet in length with 28 feet radius at the four corners, but wide variations from these dimensions are often used particularly in Europe where 30 meters (98.4 ft.) by 60 meters (196.8 ft.) is most common.

Dasher boards must withstand amazing abuse and punishment from skaters, hockey players and equipment, and bumping by heavy resurfacing machines as well as strong pressure from the expanding and contracting ice slab. This pressure also comes from water, either from melting, condensation and resurfacing procedures, being constantly refrozen in the vertical joint between the ice slab and the bottom of the dasher boards. Therefore conventional dasher boards must be anchored securely into concrete or some other equally strong bond with the ground thus requiring special construction features that make the area either quite specialized or quite expensive, as in the case of a multipurpose indoor sports arena or colliseum.

It is the purpose of this invention to provide a method for securing dasher boards surrounding an ice rink in which no fastening into the ground is required of any kind and thus no special construction features are required before the rink is erected. Thus the rink may be set on any level area such as a a grassy playing field, tennis courts, parking lot, dirt or sand covered area, wooden or concrete floor, mall, stage, etc.

It is a further purpose to simplify and reduce the cost of installation of ice skating rinks in recreational areas. Another purpose is to provide a portable structure which can be moved from one place to another or set up in the same place seasonally so that the area can be put to another use in the non-skating season.

Another purpose is to provide a header box within the base of the dasher boards which eliminates the need for the usual expensive header trench and its covers.

Another purpose is to prevent the so-called "edge effect" in which the ice at the outer edge of an ice rink is softer or wetter because of the additional heat conducted from outside and because it is difficult to make freezing pipes uniform in curved corner sections.

A still further purpose is to provide a water-proof barrier at the perimeter as well as over the rink floor so that the rink may be flooded and frozen all at one time instead of the usual expensive practice of putting on a little water at a time and letting it freeze and repeating this every hour or so for 24 hours a day for several days.

An additional advantage is that this invention enables the provision of an absolutely level ice rink over a not-perfectly level area, such as tennis courts pitched for drainage, by using the water tight perimeter to form a shallow pool over the whole area and floating the plastic freezing pipes or tubes on this pool level.

THE INVENTION

The present invention provides a method for securing a perimeter fence around an ice rink by utilizing a series of metal posts, shaped like an upside-down square-cornered question mark or an inverted hook of a large hook and eye, supporting the dasher boards in a cantilever relationship on the vertical legs of the posts. There is a horizontal ground leg extending out under the ice sheet for support and for anchoring into the ice. The dasher board clears the horizontal ground leg by a vertical space all around the perimeter of the rink. This vertical space being sufficiently large for permitting the plastic freezing pipes or tubes to go out beyond the bottom of the boards by an offset distance of several inches to a foot or more.

Thus refrigeration provided in the space below and behind the borad and in front of the lower vertical support leg is used to build up a substantial thickness of ice several inches thick. This ice and the bond under the board to the main ice floor can be strengthened by the use of sand, wood pulp, finely shredded paper pulp, etc.

The upper horizontal leg, in addition to supporting the main vertical riser to which the dasher board is attached, acts as a support for a cover over the locking ice behind the board and as a support for a walkway or bench useful for spectators or skaters resting or adjusting their skates. This upper horizontal leg is spaced ½ to 1½ feet above the horizontal ground leg.

By extending the upper horizontal leg outwardly in a direction away from the ice attaching a second lower vertical member spaced out from the ice by a distance of a foot more or less, a header box is provided to enclose the main refrigeration headers and provide connection to the rink refrigeration pipes or tubes under the above cover.

A waterproof film, either laid over the entire rink floor or only the outer edge of it, is pulled under the horizontal ground leg and up the outside of the lower vertical support leg and attached to a wooden horizontal member connecting this lower leg of each post assembly. This, together with the frozen sand or pulp provides a water-tight wall to hold the water for freezing to the required height of ice.

Pipes or tubes for refrigerant brine flow which are made of polyethylene, or largely of polyethylene, are lighter than water and will float provided an anti-freeze liquid, such as methanol and water, which is also lighter than water, is used. Thus the refrigerant brine pipes or tubes can be made to float dead level even though the floor underneath may be uneven. When the freezing around the pipes or tubes and the water below has been completed, thereby advantageously forming an absolutely horizontal ice table surface, more water can then be flooded on top of this ice table to provide an inch or so of horizontal ice above the pipes or tubes.

As used herein the term "brine" is intended generically to include anti-freeze liquids of all kinds as used to freeze ice rinks regardless of whether they contain salt. For example water plus methanol or water plus ethylene glycol may be considered as "brine."

BRIEF DESCRIPTION OF THE DRAWINGS

FIG. 1 illustrates a cross-section of portable design ice rink employing the present invention and showing major components utilized when the invention is employed;

FIG. 2 is a plan view of the ice rink of FIG. 1 shown on reduced scale and showing a schematic circuit diagram of the ice freezing system;

FIG. 7 is an enlarged cross-section of the lower part of the dasher board with kickplate and lower angle iron brace attached;

FIG. 8 is an enlarged cross-section view of the top of the dasher board showing trim cap and upper angle iron brace attached.

DETAILED DESCRIPTION OF PRESENTLY PREFERRED EMBODIMENTS

Figure 3:
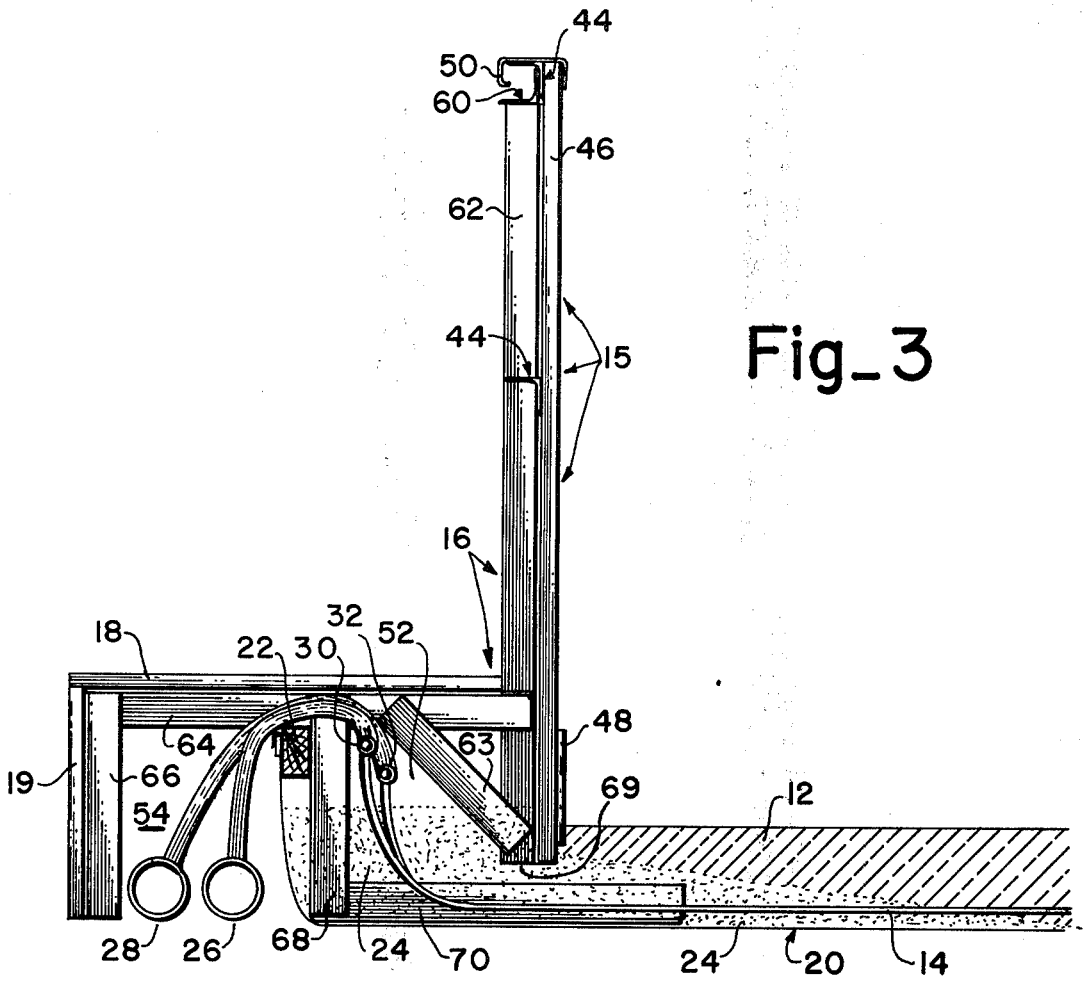
FIG. 3 is a cross-section view of the dasher board assembly and part of the ice rink of the present invention similar to FIG. 1 but enlarged and showing greater detail.

As shown in FIG. 1, the dasher board 15 is supported on a plurality of dasher supports 16 which rest on a levelled floor or ground 17. A thin plastic liner 20 is attached to lumber 22 which is fastened to dasher supports 16. Liner 20 passes under the dasher supports 16 and sand 24 is built up few inches on top of the liner 20 thus forming a water tight perimeter which can be filled with water and frozen to form ice slab 12. Liner 20 may cover the entire rink floor, or if the water is sprayed and frozen in stages, the liner may only underlie the perimeter of the ice slab.

Ice slab 12 may be formed in layers with water introduced and frozen in steps until ice slab 12 is 1½ to 2 inches thick. Alternatively, the water may be flooded in forming a pool on which the brine tubing floats which is then frozen solid to the ground to form a horizontal ice table. Then ice is built on top of the frozen ice table by more flooding to a depth of an inch or so.

Prior to building up sand 24 on top of liner 20 brine tubings 14 are laid out across the ice rink. Two ends of brine tubing 14 (see also FIG. 3) pass under the dasher board 15 and reach approximately to the point where lumber 22 is installed on dasher support 16. It is important to do so because by virtue of this, the ice slab 12 will be built up not only in front of the dasher support 16 and dasher board 15 but also behind them therefore anchoring the dasher support 16 and dasher board 15.

One end of the brine tubings 14 is connected to the supply subheader 30 (seen more clearly in FIG. 3) and return subheader 32. Subheaders 30 and 32 are connected to the supply header 26 and the return header 28 through flexible connectors or hoses 56. Supply header 26 and return header 28 are generally located away from ice slab 12 and are easily accessable. The other ends of tubings 14 form a loop and generally do not have any subheaders or headers attached thereto, as will be understood from FIG. 1.

FIG. 2 illustrates the layout of the portable ice rink of FIG. 1 showing the basic components. Dasher boards 15 mounted on dasher supports 16 are joined together to form a perimeter typically around a 85 × 200 foot area with corners of the perimeter being at 28 feet radius. Various different portable dasher board sections are shown including standard straight portable dasher board 2. Standard curve portable dasher board 4, team or public gate 6, resurfacing machine (Zamboni) gate 8 and filler straight portable dasher board 10. All dasher board sections 2, 4, 6, 8 and 10 are supported on dasher support posts 16. The mechanical room 38 is located away from the perimeter of the dasher boards. The mechanical room houses the refrigeration equipment which includes refrigeration chiller 34, brine pump 36, mixing tank 37, etc.

Brine supply and return main pipes 40 connect refrigeration equipment to brine supply header 26 and return header 28. The brine supply header 26 and the brine return header 28 are located behind the dasher boards and along the rink length. The brine headers 26 and 28 are connected to the brine supply subheaders 30 and brine return subheaders 32 with the flexible connectors or hoses 56, as shown in FIG. 1.

The supply subheaders 30 and the return subheaders 32 are also located behind the dasher boards 15 and within the dasher support 16. Subheaders 30 and 32 are connected to the grids of brine tubings 42 which are laid across the width of ice rink to cover the whole skating area ready to form ice slab on the top of these tubings. These grids of brine tubing may be made of 1 inch or 1¼ inches plastic pipe on 3 inches, 3½ inches, or 4 inches centers or they may be much smaller as disclosed in my earlier patent with Helmut J. Schmidt, U.S. Pat. No. 3,751,935, dated Aug. 14, 1973, entitled "Method and System for Creating and Maintaining An Ice Slab."

FIG. 3 illustrates a detailed cross section of the rink at portable dasher board 15 and dasher support 16. Dasher boards major components shown are angle iron members 44, plywood 46, kickplate 48 and dasher cap 50. Portable dasher board 15 is attached to dasher support 16 which comprises a top horizontal angle iron member 60 welded to a vertical angle iron member 62 forming an upper vertical leg which is in turn welded in cantilever relationship to the inner end of a horizontal angle iron 64, which forms an upper horizontal leg. Between angle iron members 62 and 64 another angle iron 63 is welded as a diagonal brace. It is noted (as shown in FIG. 3) that the lower end of the uper vertical leg 62 extends down beyond the inner end of the upper horizontal cantilever leg 64 sufficiently far that this end 69 dips into the ice slab. The diagonal brace 63 extends down to this lower end 69.

The horizontal cantilever leg 64 is attached, for example as by welding, to the top of a lower vertical support leg 68 (FIG. 3) provided by an angle iron member. The horizontal cantilever leg 64 extends out beyond the edge of the ice slab and is fastened by welding to the top of a second lower vertical support member 66.

The first lower vertical support leg 68 is anchored, for example by welding, to a lower horizontal ground leg member 70 formed by an inwardly extending angle iron. Horizontal angle iron member 70 rests on the liner 20.

The structural arrangement of all the horizontal and vertical members of the dasher support 16 is made in such a way that the support is balanced, and two such supports can stand on a reasonably levelled floor without any external support, when a portable dasher board 15 is attached to two such dasher supports 16 at opposite ends of the dasher board. The assembly of a dasher board 15 with a pair of such supports 16 at its opposite ends is a stable assembly well supported without the risk of falling in any direction. In other words, as seen in FIG. 3, the center of gravity of an assembly of a dasher board 15 plus two supports 16 located at opposite ends of this board is positioned over the base provided by the horizontal ground leg 70 and outer leg 66. This makes it possible to assemble the whole dasher board perimeter prior to laying out brine tubings and brine header pipes.

Top horizontal member 60 of dasher support 16 is fastened to top angle iron 44 of two adjacent dasher boards 15 and keeps the dasher boards 15 from separating when hit or pushed from the ice side either by players or resurfacing machine. Vertical angle iron member 62 is also fastened to two adjacent dasher boards with the help of mechanical fasteners. The basic function of this is to hold dasher boards in place and keep them in vertical alignment.

The bottom part of the vertical angle iron member 62 and lower part of the dasher board 15 is under the ice slab and frozen sand. Moreover the horizontal member 70 of the dasher support 16 is totally under the ice slab and the frozen sand which makes the whole assembly well anchored to rink ice slab 12.

Horizontal angle iron member 64 of dasher support 16, apart from being a structural member, serves as a walkway for the players and a stand for the spectators when plywood cover 18 is installed on top. A plywood cover 19 is fastened to outer vertical leg members 66 to enclose the area within the dasher support members.

The space formed between vertical members 66 and 68 is the dry compartment 54. The dry compartment 54 houses brine supply header 26 and brine return header 28.

Vertical angle iron member 68 is about same length as member 66 and is attached to another horizontal angle iron member 70. Member 68 is about halfway between member 66 and member 62 and divides the header enclosure into two compartments, i.e., the dry compartment 54 as described above and the wet compartment 52 whichis the space between member 68 and member 62. The wet compartment 52 houses the brine supply subheaders 30 and the brine return subheaders 32. It is filled with sand 24 to several inches high. Sand 24 is filled to keep the plastic liner 20 from floating and to obtain water sealing effect and also to obtain a stronger slab of frozen sand and ice so that the dasher support post 16 and dasherboard 15 have better hold or anchoring to the ice sheet 12.

Plastic liner 20 is spread under the horizontal angle iron member 70. One end of the plastic liner 20 is attached to the lumber 22 which is fastened between the vertical angle iron members 68 of various dasher support posts 16. The other end of the plastic liner 20 reaches a few feet beyond the end of the horizontal member 70 inside the rink, or where pool-type (horizontal ice table formation) flooding is done the liner must underlie the whole rink floor. This lower horizontal leg member 70 is a sort of an anchoring base for the dasher support post 16.

The perimeter of dasher boards 15 is assembled prior to installing the brine tubings 14 and making the ice slab 12. The plastic liner 20 is spread at about the perimeter of the rink and the dasher supports 16 are placed over the plastic liner 20, then dasher boards 15 are assembled to the dasher supports.

After all the dasher boards are assembled the brine tubings 14 are rolled out between the dasher boards 15 and then the outer end of the liner 20 is attached to the lumber 22. Sand 24 is then spread over the liner 20 inside the wet compartment 52 as well as all over the liner so that the free end of the plastic liner 20 is pressed to the ground or floor 17 (shown in FIG. 1). Then the ice slab can be made in a standard manner after making necessary connections between supply subheaders 30, return subheaders 32, supply header 26, return header 28 and the refrigeration equipment (shown in FIG. 2).

Various major components of a dasher board 15 are also shown in this figure, they are angle iron horizontal members 44, plywood 46, kickplate 48 and the dasher cap 50.

Figure 4:
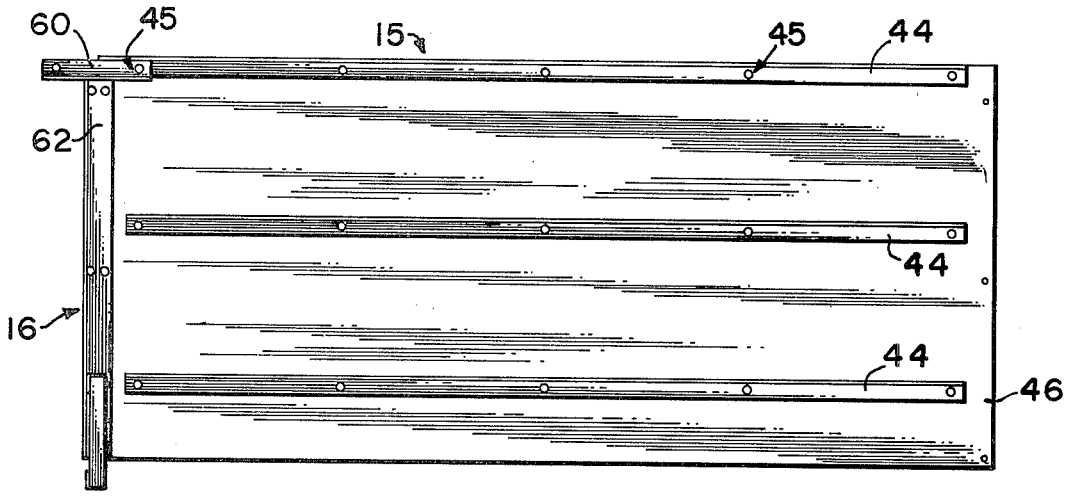
FIG. 4 is a horizontal view of a dasher board section and one post without the header box viewed from the outside of the rink.

FIG. 4 illustrates the way a typical dasher board 15 is assembled with dasher support 16 showing the assembly from the back side, the outside of the ice slab. Dasher board 15 has two major components, the plywood 46 and three horizontally mounted angle iron members 44. Angle iron members 44 and plywood 46 are preassembled to each other with the help of mechanical fasteners 45 which are generally bolts, nuts and washers. Uppermost angle iron 44 is fastened to the top horizontal member 60 of the dasher support 16 with the help of mechanical fastener 45. Basic function of this joint between upper angle iron 44 of typical portable dasher board 15 and top horizontal member 60 is to hold two adjacent dasher board 15 together and stop them from moving apart when players batter against them or resurfacing machine hits them. The plywood 46 of the dasher board 15 is fastened to the vertical member 62 of the dasher support 16 with the help of mechanical fasteners 45.

Figure 5:
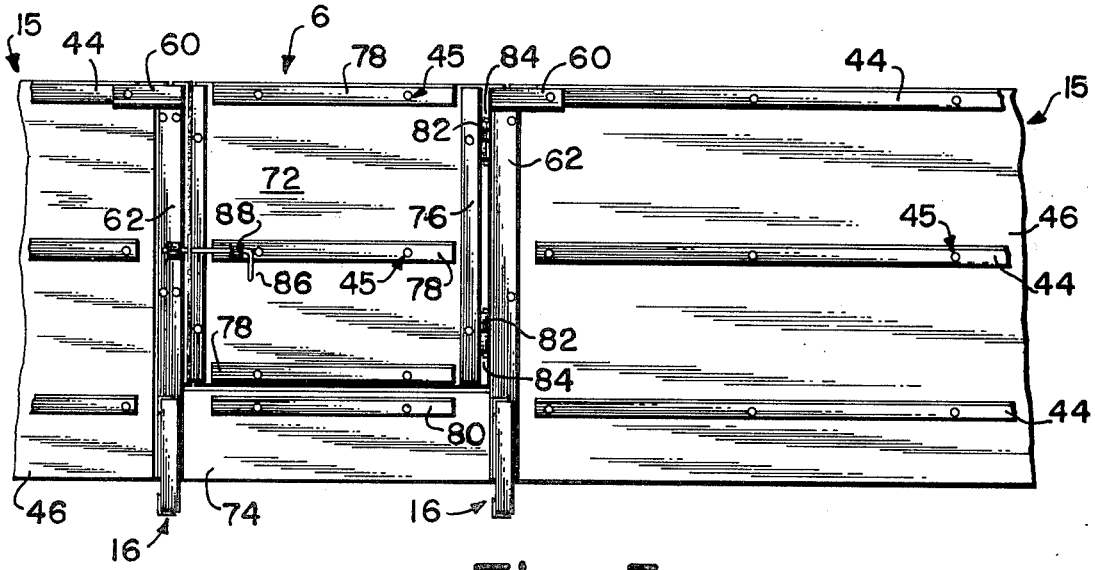
FIG. 5 is the same as FIG. 4 but showing a gate section for skaters to pass through or to close for ice hockey play.

FIG. 5 shows the team or public gate 6 assembled with adjacent dasher boards 15 through dasher support 16.

Various components of the gate 6 shown are door plywood 72, sill plywood 74, door angle iron vertical members 76, door angle iron horizontal members 78, sill angle iron horizontal member 80, hinge steel tubings 82, hinge steel pins 84, latch slide bolt 86, and latch guide tubings 88. Gates are assembled using nuts, bolts and washers 45 as is done in the case of dasher boards 15. Plywood 46 and angle iron members 44 are also shown in this figure as part of adjacent dasher boards 15.

The two dasher supports 16 on which the gate 6 is mounted are slightly different from regular design in the way that their top horizontal angle iron members 60 do not project farther than their vertical edge of angle iron members 62 on the door side to facilitate opening and closing of gate 6.

The lower edge of the sill plywood 74 is anchored in the ice along with the two dasher supports 16 on which the gate is mounted.

Figure 6:
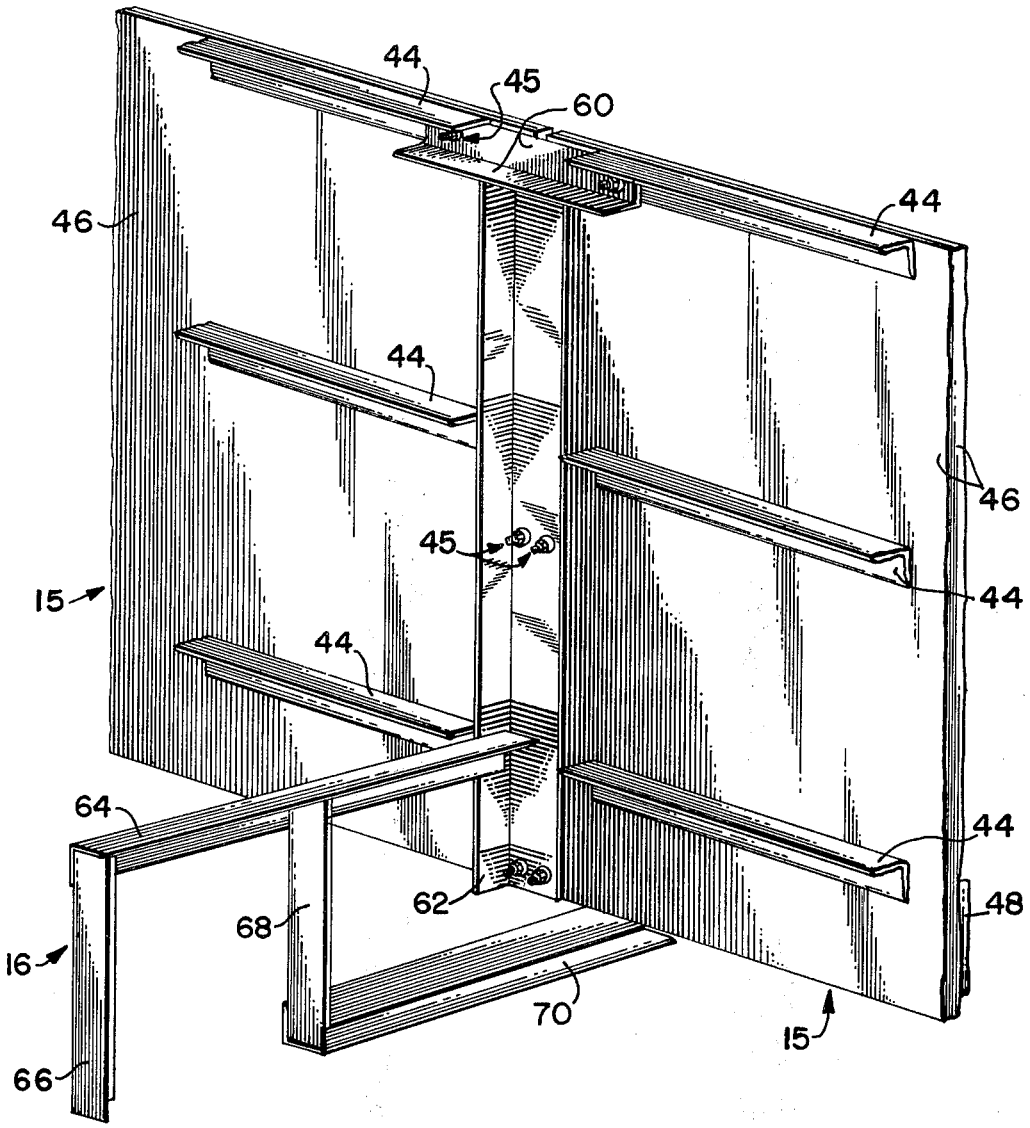
FIG. 6 is a perspective view of parts of two dasher boards attached to a mounting post.

FIG. 6 is a pictorial view which show typical dasher boards 15 and dasher support 16 looking from the back side of the dasher boards. Various components visible in the figure have been discussed in detail under FIGS. 3 and 4.

Typical dasher boards 15 is shown with three basic components, i.e., angle iron members 44, the plywood 46 and the kickplate 48. The dasher boards 15 are mounted on the dasher support posts 16 with the help of nuts, bolts and washers 45. Dasher support post 16 is shown with horizontal angle iron members 60, 64, and 70 and vertical angle iron members 62, 66 and 68.

FIG. 7 shows the cross-section of the lower parts of a typical dasher board 15. Various components of the dasher board 15 are more clearly visible.

Angle iron member 44 is mounted on the dasher board plywood 46 by means of flat head screw 90, hex nut 92 and a washer 94. Kickplate 48 is mounted on the plywood 46 with the help of nylon anchors 96. The mounting of all the fasteners is done in such a way that heads do not protrude on the ice side of the dasher board 15 and offer a smooth surface on the ice side for the skaters or players.

FIG. 8 shows the cross-section of the upper part of a typical dasher board 15. Various components of the top part of the dasher board are very clearly visible in this figure.

Angle iron member 44 is mounted on the plywood 46 with help of nuts, screws, etc. (not shown). Dasher cap 50 which is special shape generally extruded ABS is mounted on the top of the edge of plywood 46 and angle iron member 44. Fastener used to mount the dasher cap 50 are blind rivets 98 which fasten the cap 50 to angle iron member 44.

As the reader will readily understand, the specific structural details, described above in one particular form may be done in many different ways to accomplish the purpose of freezing one integral ice slab which extends beyond the perimeter fence to lock it into the slab. The solid panels of the fence must be supported so that there is a clear unobstructed space between their bottom horizontal edge and the ground through which the freezing tubes, pipes, conduits, lines, panels, mats, or other form of refrigerated surface may extend from the rink area to behind the perimeter fence panels, or dasher boards.

The advantage of structurally solidly holding the fence in place by the freezing action can be readily understood because embedding into the ground or into concrete footings is eliminated, the preparation necessary for fastening is eliminated, and the ice rink locations can thus serve as multi-purpose areas at far lower cost both for property and construction.

However, there are other advantages connected with moving the edge of the ice slab outwardly beyond the vertical plane of the cantilevered fence. There has always been a problem in the prior art of the ice near the perimeter being of different quality from the rest of the ice largely because of the thermal "edge effect." Heat from the perimeter would flow into the ice at the edge at a much greater rate than heat from the ground below the ice. In fact Chapter 56 on Ice Skating Rinks of the Applications Volume of the Guide and Data Book put out by the American Society of Heating, Refrigerating and Air Conditioning Engineers states that a maximum of 6% of the thermal load on the ice comes from the ground below. However, 25 to 50% of the thermal load on the ice next to the dasher boards may come from heat flowing from the edge.

By moving the ice edge outwardly beyond the plane of the fence by about a foot the ice just inside the fence receives a heat load comparable to the main ice slab and thus is of similar quality. The fact that the new outer edge varies is unimportant since it is unused and covered up.

Also it is difficult in presently known rinks to construct freezing tubes, pipes, conduits, lines, panels, mats or other form of refrigerated surface to fit exactly to the radiused corners of the rink which are virtually always desired. Thus little triangles of ice on these curved edges will be warmer, resulting in ridges, because of varying distances of these portions of the ice from the refrigerating conduit. An advantageous result of employing the present invention is that these triangles are moved out behind the perimeter fence, and thus the usable surface becomes uniform while the variations behind the fence will not matter.

Another important advantage is that the new edge being behind the fence provides a protected place to attach a waterproof liner, such as polyvinylchloride or polyethylene sheeting covering the whole rink area in one piece to hold water in a shallow pool. It is an expensive procedure to grade an 85 × 200 foot area level within one-fourth inch which is necessary to provide uniform ice. Also even if so graded initially the area may subsequently settle or heave and become off level.

Tennis courts, parking area, and the like are intentionally made non-level so that rainwater will run off and not form puddles. To use them for ice skating has been impractical because they are not level.

By using a waterproof liner, forming a shallow pool, and floating the refrigerated conduits on the surface of the water, a perfectly level ice table area can be formed with a minimum of labor. If polyethylene, or largely polyethylene, tubes, mats, pipes, or other plastic conduit for the refrigerating liquid is used, it can be made to float, particularly if a methanol or ethylene glycol antifreeze solution is used, in distinction to the denser calcium chloride brine solution.

The freezing of the ice is done in two stages instead of 20 or so as is commonly done now, thus saving labor and time. With refrigerating tubes floating on the surface of a shallow watertight pool, the entire water content can be left to freeze solid. The water may be only an inch at the shallowest and a foot or more at the deepest but it will freeze solid eventually. Even if there is a deeper depression of more than a foot, perhaps even many feet deep, it does not matter whether the water freezes all the way down since the ice above is not only a structural bridge but also floats on the heavier water below.

Present methods of building an ice slab are almost entirely limited to spraying and building up layers of ice one-sixteenth inch at a time because it is very difficult to make a completely watertight rink structure without a liner. Concrete retaining curbs are almost always cracked by the horizontal expansion force of the ice. When any cracks are formed water gets in and when frozen, it spalls and enlarges the cracks.

Waterproof liners are not practical on present rinks because they would have to be attached on the inside of the dasher boards where they are subject to abuse, stress, sharp edges, etc. The present invention provides a protected area to attach such a liner well away from skates, sticks, nails, screws and the like.

Since this invention provides a boxed enclosure at the outside base of the perimeter fence all around to cover the ice behind the fence, it makes an excellent place to house header pipes as well as is illustrated and described previously. Commonly header pipes are located in concrete trenches which become unusually expensive. Trenches must have drains to take water away, since large amounts of water flow in when the ice melts as well as condensation at other times.

Also trenches require strong, usually steel, covers to allow machinery and people to walk over. The concrete walls must be insulated to prevent heaving and cracking, and the sections must be thick. They are inconvenient for access to refrigerant connections, and they tend to fill with ice and frost and dirt.

The header box provided in the system of the present invention is far cheaper, more accessible, cleaner, and is totally removable. It provides a raised area needed for people to see over the boards when seated or small children when standing. There are no problems of drainage or heaving, and the frost and ice accumulation is purposeful and useful, not a deterrent.

From the foregoing description it will be understood that the present invention provides a method of securing a perimeter fence around an ice rink without attachment to the ground giving advantages of low cost, portability, adaptability with other advantages as discussed above, and it is to be understood that the scope of the present invention as defined by the following claims is intended to include elements which are equivalent of those being claimed hereinafter.

I claim:

1. A method of preventing high stress forces between the ice slab of an ice skating rink and its perimeter fence including the steps of A. securing perimeter fence panels to vertical supporting posts whose feet rest on the ground below the bottom edge of said fence panels, B. placing ice freezing conduits over the ground rink area and extending under and outside said fence panels, C. refrigerating said freezing conduits by conventional refrigerating means, and D. covering said freezing conduits with water and freezing an ice slab over the rink area and behind and above the lower edge of said fence panels whereby said fence panels and said vertical posts will be frozen rigidly in said ice slab and will be free to move with the expansion and contraction forces of said ice slab.

2. A method of securing uniform freezing effect on the ice adjoining the perimeter of an ice rink including the steps of A. securing perimeter fence panels to vertical supporting posts whose feet rest on the ground below the bottom edge of said fence panels, B. placing ice freezing conduits over the ground rink area and extending under and outside said fence panels, C. refrigerating said freezing conduits by conventional refrigerating means, and D. covering said freezing conduits with water and freezing an ice slab over the rink area and behind and above the lower edge of said fence panels whereby the actual edge of the ice slab is moved outward behind the perimeter fence so that the thermal heat flow into the edge does not affect the ice inside the perimeter fence, and the freezing conduits, being distributed uniformly under and behind said perimeter fence, give uniform heat withdrawal from said ice just inside the perimeter fence.

3. A method of constructing a rigid, vertical-standing, perimeter fence around an ice skating rink without fastening the fence into the ground including the steps of A. securing perimeter fence panels to vertical supporting posts whose feet rest on the ground below the bottom edge of said fence panels, B. placing ice freezing conduits over the ground rink area and extending under the outside said fence panels, C. refrigerating said freezing conduits by conventional refrigerating means, and D. covering said freezing conduits with water and freezing an ice slab over the rink area and behind and above the lower edge of said fence panels whereby said perimeter fence panels the vertical supporting posts will be held rigidly in position by the freezing of the ice surrounding them which is a part of the entire ice slab.

4. A method of constructing a rigid, vertical standing, perimeter fence around an ice skating rink as claimed in claim 3 in which sand is used as a binder to strengthen the ice bond between the ice behind and the ice inside of the perimeter fence.

5. A method of constructing a rigid, vertical standing, perimeter fence around an ice skating rink as claimed in claim 3 in which a water proof liner is spread over the ground under the entire rink and the edge of the liner raised and attached to part of said supporting posts spaced behind said perimeter fence panels whereby said liner will hold water in a shallow pool to aid in the freezing of said ice slab.

6. A method of constructing rigid, vertical standing, perimeter fence around an ice skating rink as claimed in claim 5 in which said ice freezing conduits together with the antifreeze liquid inside them are lighter than water.

7. A method of constructing a rigid, vertical standing, perimeter fence around an ice skating rink as claimed in claim 3 in which the ice outside the perimeter fence is enclosed in a box attached to said supporting posts.

8. A method of constructing a rigid, vertical standing, perimeter fence around an ice skating rink as claimed in claim 7 in which the box which encloses the ice outside the perimeter fence also encloses the header pipes.

9. A method of constructing a rigid, vertical standing, perimeter fence around an ice skating rink without embedding support members for the fence into the ground including the steps of A. positioning supporting posts at intervals around the perimeter of the rink on relatively flat ground, said posts having a horizontal ground member substantially at right angles to the rink perimeter, a vertical member spaced above, separated from and rising over the middle portion of said horizontal ground member, and connecting members between said ground member and vertical member to hold said vertical member in position by attachment near the outer end of said ground member, B. attaching rigid fence panels to said vertical members leaving a space between the lower edge of said panels and the ground or said ground members, C. placing ice freezing conduits over the ground rink area and extending under said fence panels to a position outside of said fence panels, D. refrigerating said freezing conduits by conventional refrigerating means, and E. covering said freezing conduits with water and freezing an ice slab over the rink area and behind and above the lower edge of said fence panels whereby said fence panels and supporting posts will be held rigidly in position by the freezing of the ice surrounding them which is a part of the entire ice rink slab.

10. A method of constructing a rigid vertical standing, perimeter fence around an ice skating rink as claimed in claim 9 in which sand is used as a binder to strengthen the ice bond between the ice behind and the ice inside of the perimeter fence.

11. A method of constructing a rigid vertical standing, perimeter fence around an ice skating rink as claimed in claim 9 in which a water proof membrane is spread over the ground under the entire rink and the edge of the membrane raised and attached to part of said supporting posts spaced behind said perimeter fence panels whereby said membrane will hold water in a shallow pool to aid in the freezing of said ice slab.

12. A method of constructing a rigid vertical standing, perimeter fence around an ice skating rink as claimed in claim 11 in which said ice freezing conduits together with the antifreeze solution inside them are lighter than water.

13. A method of constructing a rigid vertical standing, perimeter fence around an ice skating rink as claimed in claim 9 in which the ice outside the perimeter fence is enclosed in a box attached to said supporting posts.

14. A method of constructing a rigid vertical standing, perimeter fence around an ice skating rink as claimed in claim 13 in which the box which encloses the ice outside the perimeter fence also encloses the header pipes.

* * * * *